US007832701B2

(12) United States Patent
Barnes

(10) Patent No.: US 7,832,701 B2
(45) Date of Patent: Nov. 16, 2010

(54) EASY OPEN PORTABLE EASEL

(76) Inventor: Bobby M. Barnes, 923 Mountain Valley Rd., Axton, VA (US) 24054

( * ) Notice: Subject to any disclaimer, the term of this patent is extended or adjusted under 35 U.S.C. 154(b) by 134 days.

(21) Appl. No.: 12/250,215

(22) Filed: Oct. 13, 2008

(65) Prior Publication Data

US 2009/0039229 A1 Feb. 12, 2009

Related U.S. Application Data

(63) Continuation-in-part of application No. 11/401,214, filed on Apr. 11, 2006, now abandoned.

(51) Int. Cl.
*A47B 97/04* (2006.01)

(52) U.S. Cl. ..... 248/460; 248/441.1; 248/458; 248/463

(58) Field of Classification Search ..... 248/447, 248/166, 168, 170, 188, 163.1, 169, 171, 248/146, 150, 440, 441.1, 460, 463, 458, 248/443, 444, 448, 459, 464, 465; 403/109.1
See application file for complete search history.

(56) References Cited

U.S. PATENT DOCUMENTS 2,282,285 A * 5/1942 Olson ..... 248/169
3,315,930 A * 4/1967 Cota ..... 248/171
D291,153 S * 8/1987 Nakatani ..... D6/312
5,062,606 A * 11/1991 Hoshino ..... 248/171
5,503,357 A * 4/1996 Johnson et al. ..... 248/188.5
7,182,303 B2 * 2/2007 Speggiorin ..... 248/168
2006/0192071 A1 * 8/2006 Choi ..... 248/460
2007/0075209 A1 * 4/2007 Kapp ..... 248/460

* cited by examiner

*Primary Examiner*—J. Allen Shriver
*Assistant Examiner*—Todd M. Epps
(74) *Attorney, Agent, or Firm*—Dale J. Ream

(57) ABSTRACT

A portable easel includes a cap plate defining a first leg receiving area and a second leg receiving area spaced apart from the first leg receiving area. The easel includes first and second legs each having a coupling member at an upper end that is pivotally coupled to the cap plate at a respective receiving area. Each coupling member includes a flange extending from a terminal end thereof. Each receiving area defines a cavity configured to receive a respective flange therein, each flange being movable therein between opposed stops such that each of the first and second legs are movable between open and closed configurations. Gas springs are operatively coupled to respective legs. The easel includes support structures for holding an artist's canvas. A ground stake is pivotally coupled to lower ends of each leg for selectively anchoring the easel to a ground surface.

8 Claims, 15 Drawing Sheets

EASY OPEN PORTABLE EASEL

REFERENCE TO RELATED APPLICATIONS

This application is a continuation-in-part application that claims the benefit of U.S. application Ser. No. 11/401,214 filed Apr. 11, 2006 now abandoned and titled Easy Open Portable Easel

BACKGROUND OF THE INVENTION

This invention relates generally to easels and, more particularly, to a portable easel that is easy to set up, sturdy, easy to carry, and suitable for indoor or outdoor use.

Easels are common to most artists, painters in particular. A single style of easel is not generally adaptable for the wide range of requirements for artists who paint, draw or sketch in various locations such as outdoors and indoors. Use of an easel outdoors can be especially challenging due to the varying terrain, weather, objects and subjects.

Various styles of easels have been proposed in the prior art. Although presumably effective for their intended purposes, the existing easels do not suit all needs or all conditions. Therefore, it would be desirable to have a portable easel that is light weight and foldable and that may be used indoors and outdoors with a minimum amount of set up time. Further, it would be desirable to have a portable easel that may be carried from place to place. In addition, it would be desirable to have a portable easel that may be selectively anchored to a ground surface.

SUMMARY OF THE INVENTION

A portable easel according to the present invention includes a cap plate defining a first leg receiving area and a second leg receiving area spaced apart from the first leg receiving area. The easel includes first and second legs each having a coupling member at an upper end that is pivotally coupled to the cap plate at a respective receiving area. Each coupling member includes a flange extending from a terminal end thereof. Each receiving area defines a cavity configured to receive a respective flange therein, each flange being movable therein between opposed stops such that each of the first and second legs are movable between open and closed configurations. Gas springs are operatively coupled to respective legs. The easel includes support structures for holding an artist's canvas. A ground stake is pivotally coupled to lower ends of each leg for selectively anchoring the easel to a ground surface.

Objects and advantages of the present invention will become apparent from the following description taken in connection with the accompanying drawings, wherein is set forth by way of illustration and example, embodiments of this invention.

DETAILED DESCRIPTION OF THE DRAWINGS

Figure 2:
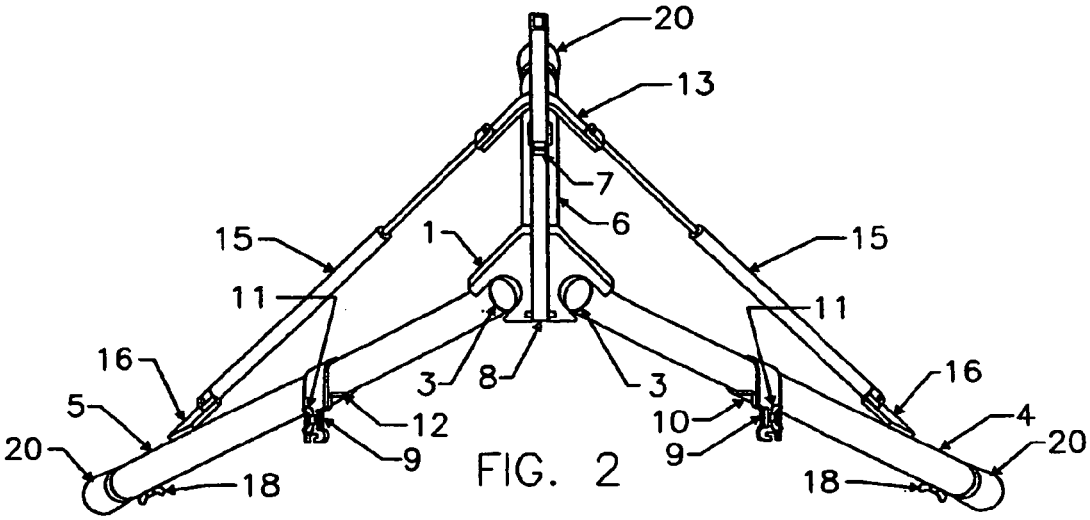
FIG. 2 is a top view of the easy open portable easel in the open position with the telescoping legs fully retracted and the upper bracket arm in the upright and locked position.
Figure 1:
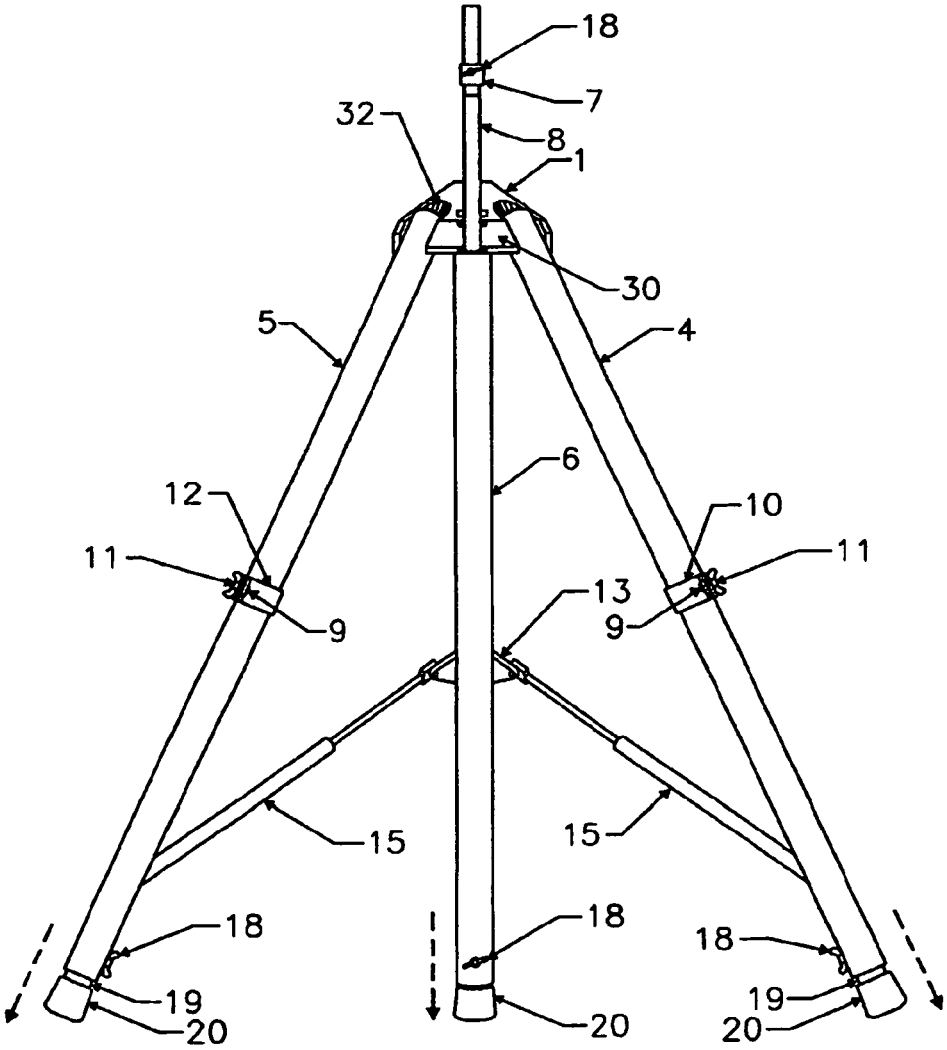
FIG. 1 is a front elevation view of the easy open portable easel in an open position with the telescoping legs fully retracted and the upper bracket arm in the upright and locked position.

A portable easel according to a preferred embodiment of the present invention will now be described with reference to FIGS. 1 to 27 of the accompanying drawings. The drawings depict an easel built in a tripod configuration; hence, there is a rear leg 6, a left front leg 5, a right front leg 4 and a cap plate 1 at the apex, which forms a pivot. FIG. 1 is the front view in an open position and FIG. 2 is the top view in an open position of the easy open portable easel. Each of the numbers shown on the drawing represents a part or a surface. The easel cap plate 1 is machined for multiple functions. The rear, bottom of cap plate 1 is drilled and tapped 32 to receive the rear leg 6 which is threaded on the upper end to be screwed into 32 causing a rigid mount. The front face 30 of cap plate 1 is machined to match the slope that is formed when legs 4 and 5 are extended outward. This face surface 30 is slotted 25 and 26 to receive upper arm 8 and guide pins 23 and 24 in upper arm 8. Four screws 2 are screwed into cap plate 1 face 30, two on each side of slot 25 and through slot 26 to capture the pins 23 and 24 that are installed in upper arm 8. The right and left front corners of the cap plate 1 are machined to form a cradle 31 for legs 4 and 5. The cradles 31 are machined at 45 degrees to leg 6 and on a bevel only slightly less than the angle formed by the outward thrust of the gas springs 15 on legs 4 and 5. With the bevel on cradle 31 slightly less than the stroke of the gas springs, a stop is formed, thereby causing the legs 4 and 5 to become tight which causes the easel tripod frame to become rigid. Shoulder strap 29 is applied for ease in transport.

Upper arm 8 with guide pins 23 and 24 and top bracket 7 and thumb screw 18 is the top work piece holder and is made to be folded down when the easel is transported or stored. Upper arm 8 is in the upright locked position when pins 23 and 24 are resting on screws 2 in slot 26 when the easel is in use. Upper arm 8 can be folded down by lifting up on arm 8 to disengage pin 23 from slot 26 and swinging arm 8 out and down, allowing pin 24 to slide down to the lower screws 2 in slot 26. Top bracket 7 can be adjusted vertically by loosening thumb screw 18 and sliding bracket 7 up or down on arm 8. When the desired position for bracket 7 is obtained, tighten thumb screw 18 to prevent further movement.

Rear leg 6 is screwed into cap plate 1, making a rigid connection and has a bracket 13 attached, which serves as the attachment for the base of one gas spring 15 that extends to the left front leg 5 and the base of one gas spring 15 that extends to the right front leg 4. The bottom of rear leg 6 incorporates a thumb screw 18 and an internal nut 27 which acts as a clamp to lock in place the telescoping pipe 19 portion of rear leg 6.

Left front leg 5 is connected to cap plate 1 with one bolt 21 that goes through a hole near the top of left front leg 5 and threads into cradle 31 in cap plate 1, the bolt 21 creates a pivot for left front leg 5. Left front leg 5 has a bracket 16 attached, which serves as the attachment for the extension end of gas spring 15. Air spring 15 is attached to bracket 16 on left front leg 5 and to bracket 13 on rear leg 6 with shoulder bolts 14, with the shoulder of the bolt acting as a pivot for air spring 15. The bottom of left front leg 5 is equipped with a thumb screw 18 and an internal nut 27 which acts as a clamp to lock in place the telescoping pipe 19 portion of left front leg 5. Left front leg 5 also contains the left work piece support bracket 12, forming a compression bracket. Bracket 12 is adjustable up and down left front leg 5 by turning wing nut 11 onto threaded stud 9 causing bracket 12 to compress or loosen on left front leg 5, hence; bracket 12 can be moved up and down left front leg 5 to adjust for a wide range of work piece sizes in height. The upper end of front leg 5 is sealed with pipe cap 3. Bracket 12 is made in such a manner as to cradle utility tray 22.

Right front leg 4 is connected to cap plate 1 with one bolt 21 that goes through a hole near the top of right front leg 4 and threads into cradle 31 in cap plate 1, the bolt 21 creates a pivot for right front leg 4. Right front leg 4 has a bracket 16 attached, which serves as the attachment for the extension end of gas spring 15. Gas spring 15 is attached to bracket 16 on right front leg 4 and to bracket 13 on rear leg 6 with shoulder bolts 14, with the shoulder of the bolt acting as a pivot for gas spring 15. The bottom of right front leg 4 is equipped with a thumb screw 18 and an internal nut 27 which acts as a clamp to lock in place the telescoping pipe 19 portion of right front leg 4. Right front leg 4 also contains the left work piece support bracket 10, forming a compression bracket. Bracket 10 is adjustable up and down right front leg 4 by turning wing nut 11 onto threaded stud 9 causing bracket 10 to compress or loosen on right front leg 4; hence, bracket 12 can be moved up and down right front leg 4 to adjust for a wide range of work piece sizes in height. The upper end of front leg 5 is sealed with pipe cap 3. Bracket 12 is made in such a manner as to cradle utility tray 22.

Figure 4:
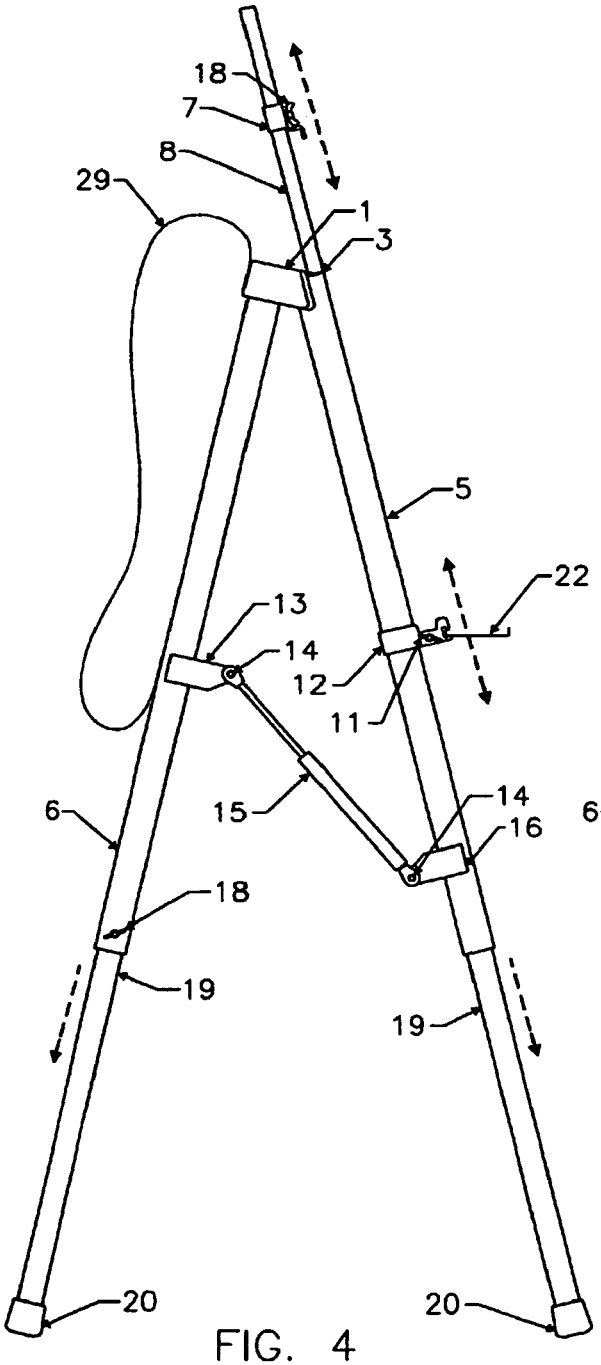
FIG. 4 is a left side elevation view of FIG. 1 of the easy open portable easel in an open position with the telescoping legs extended and the upper bracket arm in the upright and locked position.
Figure 3:
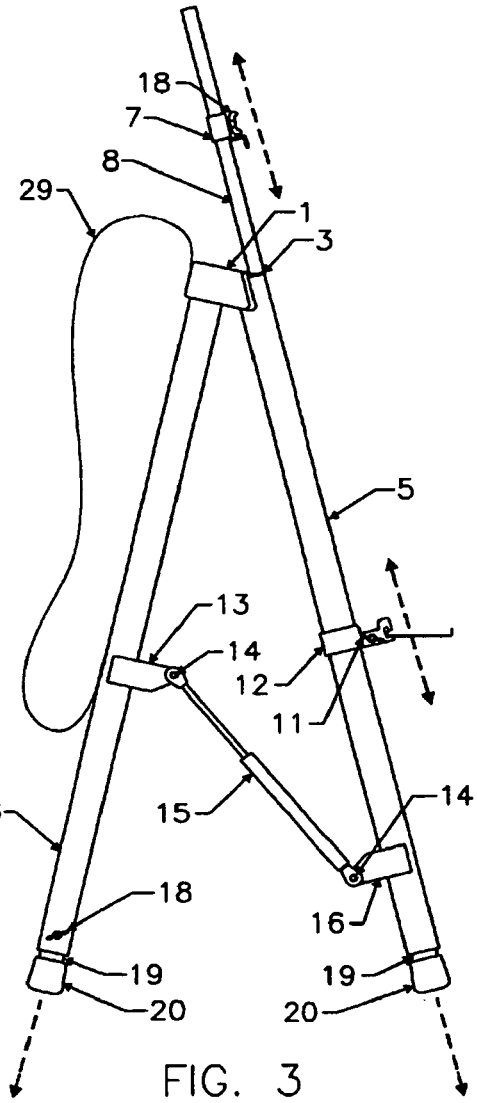
FIG. 3 is a left side elevation view of FIG. 1 of the easy open portable easel in an open position with the telescoping legs fully retracted and the upper bracket arm in the upright and locked position.
Figure 6:
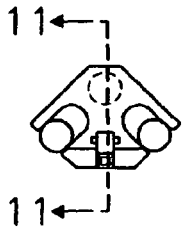
FIG. 6 is a top view of FIG. 5 of the easy open portable easel in the closed position.
Figure 8:
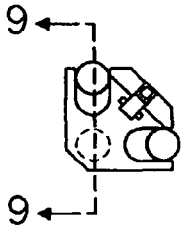
FIG. 8 is a top view of FIG. 7 of the easy open portable easel in the closed position.
Figure 9:
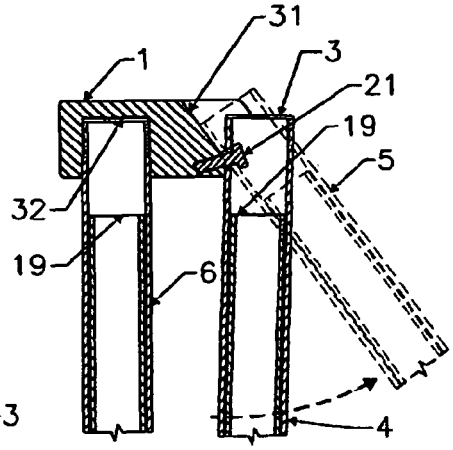
FIG. 9 is a section view of the easy open portable easel cut thru FIG. 8 by dashed lines showing the movement of leg 5.
Figure 5:
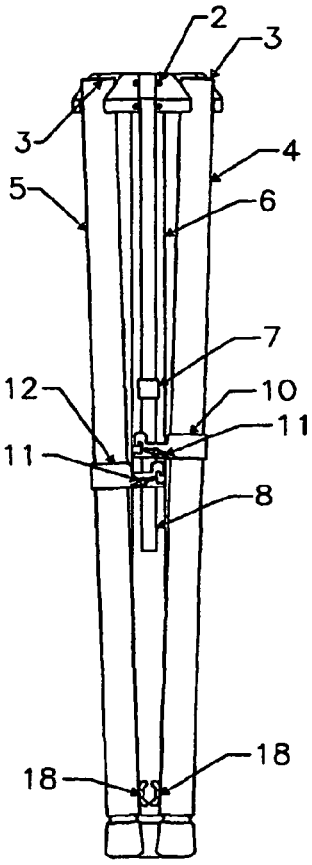
FIG. 5 is a front elevation view of the easy open portable easel in the closed position with the telescoping legs fully retracted and the upper bracket arm in closed position.
Figure 7:
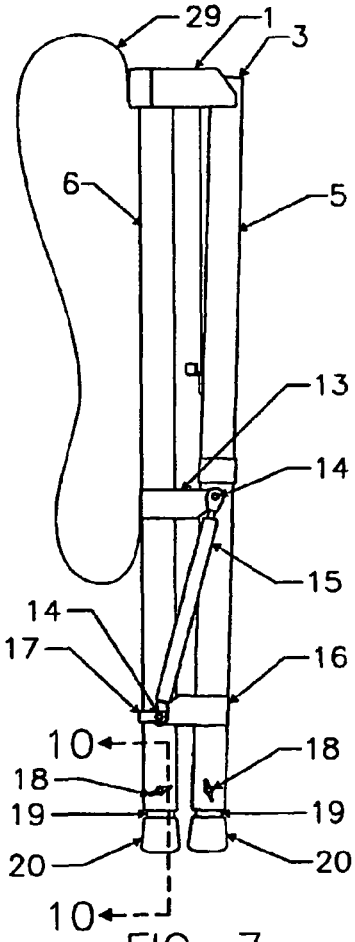
FIG. 7 is the left side elevation view of the easy open portable easel in the closed position with the telescoping legs fully retracted and the upper bracket arm in closed position.
Figure 10:
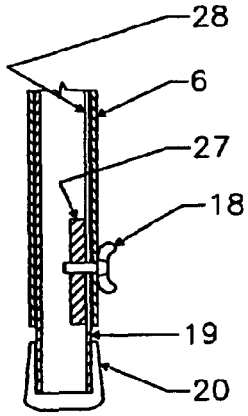
FIG. 10 is a section view of the easy open portable easel cut thru FIG. 7 by dashed lines showing the release method of the telescoping leg 19.
Figures 11, 12:
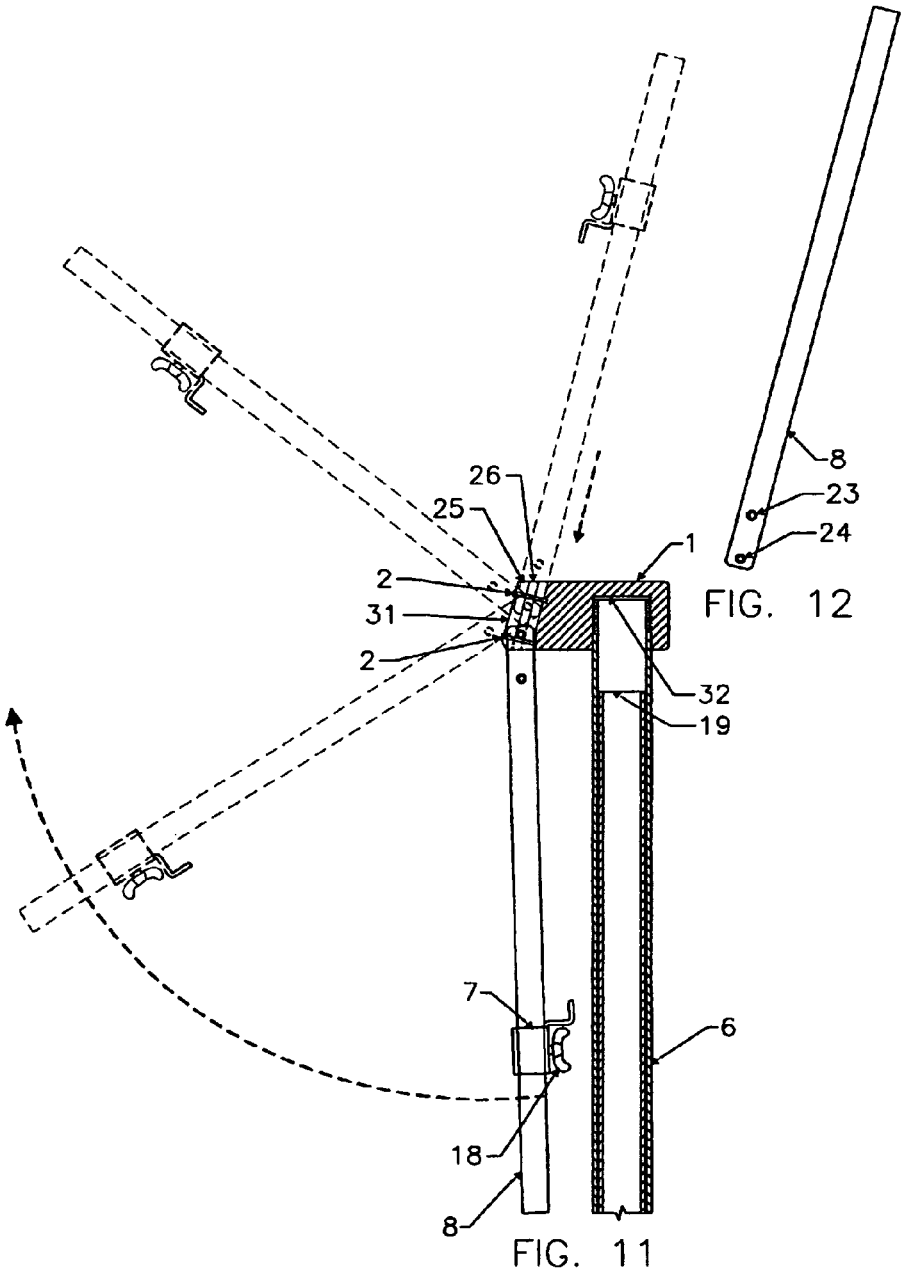
FIG. 11 is a section view of the easy open portable easel cut thru FIG. 6 by dashed lines showing the upper bracket arm movement.
FIG. 12 is a view of the upper bracket arm.

FIGS. 3, 4 and 10 show telescoping pipe 19 and cap 20 which telescope out of rear leg 6, right front leg 4 and left front leg 5. Telescoping pipe 19 is used to adjust the easel height and to adjust the orientation of the easel if it is placed on uneven surfaces. Telescoping pipe 19 is adjusted manually, telescoping in or out of rear leg 6, right front leg 4 and left front leg 5. Telescoping pipe 19 is locked into position by tightening thumb screw 18 in internal nut 27, FIG. 10. Telescoping pipe 19 is guided by slot 28 which follows along one side of telescoping pipe 19 to near each end. Thumb screw 18 goes thru the slot and is threaded into internal nut 27. The end of slot 28 is utilized to form a stop to prevent telescoping pipe 19 from sliding completely out of rear leg 6, right front leg 4 and left front leg 5.

Figures 13, 14, 15:
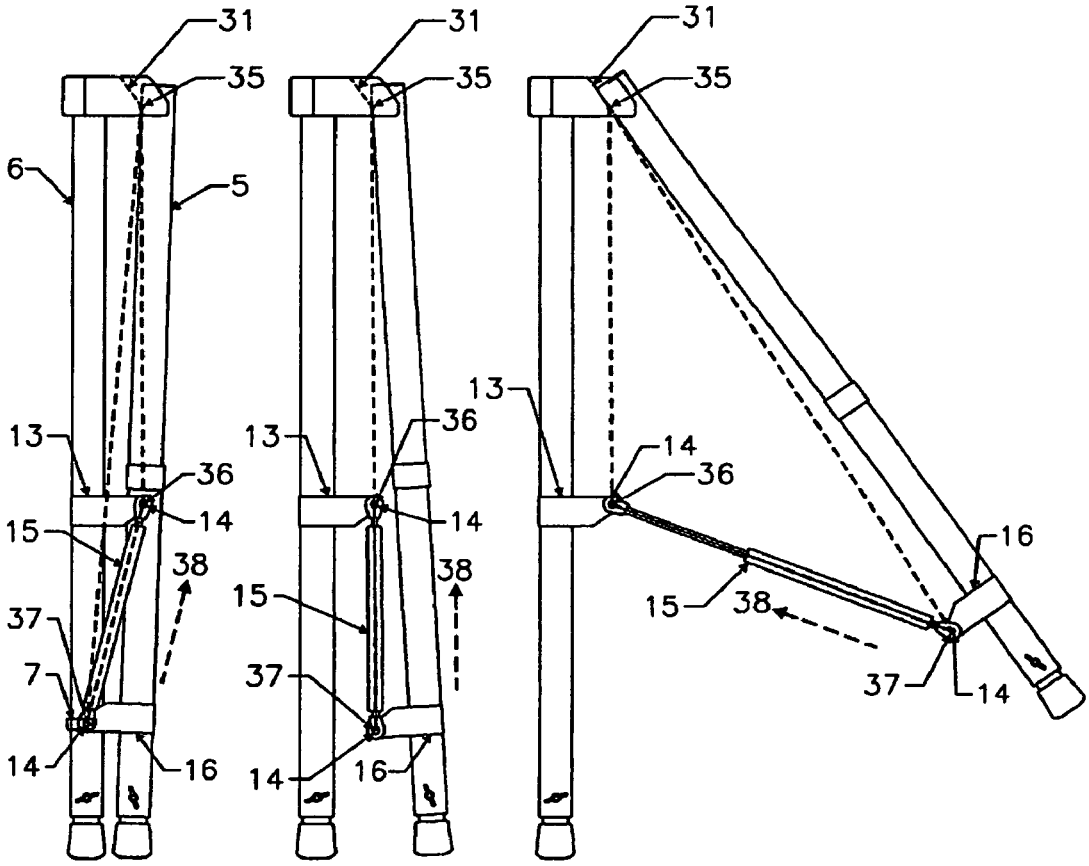
FIG. 13 is a side view of the easy open portable easel in the closed position showing the gas spring action.
FIG. 14 is a side view of the easy open portable easel in the neutral position showing the gas spring action.
FIG. 15 is a side view of the easy open portable easel in the open position showing the gas spring action.

With references to FIG. 13 to 15 gas spring 15 is an off the shelf gas spring with an outward thrust which means it is always pushing out. This outward thrust is what pushes out on left front leg 5 and right front leg 4 and holds them in position and the stop cradle 31 prevents the gas spring from reaching its fully extended position causing the tripod frame to become rigid. The principal applied to the easel leg opening and closing is the over the center method shown in FIG. 13, FIG. 14 and FIG. 15. This means that when three points, pivot 35, air spring 15 extension end 36 and air spring base end 37 are in alignment as in FIG. 14, the force 38 is still there but the gas spring is extended as far as it is allowed to go or all three points are on a common center line and the front legs 4 and 5 will remain stationary until moved off center by an external force.

If front legs 4 and 5 are moved past the center line, as in FIG. 14, toward rear leg 6, as in FIG. 13, legs 4 and 5 will be forced toward rear leg 6 by gas spring 15 and gas spring 15 will apply force in that direction and hold this position until an external force is applied to move legs 4 and 5. FIG. 13 is the normal position of rear leg 6, right front leg 4 and left front leg 5 for easel storage or transport. Elastic strap 17 is employed to prevent the easel from inadvertently being opened during storage or transport.

If front legs 4 and 5 are moved past the center line, as in FIG. 14, outwardly as in FIG. 15, legs 4 and 5 will be forced outwardly by gas spring 15 and gas spring 15 will apply force in that direction and hold this position with right front leg 4 and left front leg 5 extended as in FIG. 15. FIG. 15 is the normal position during a work session or for a display.

Figure 17:
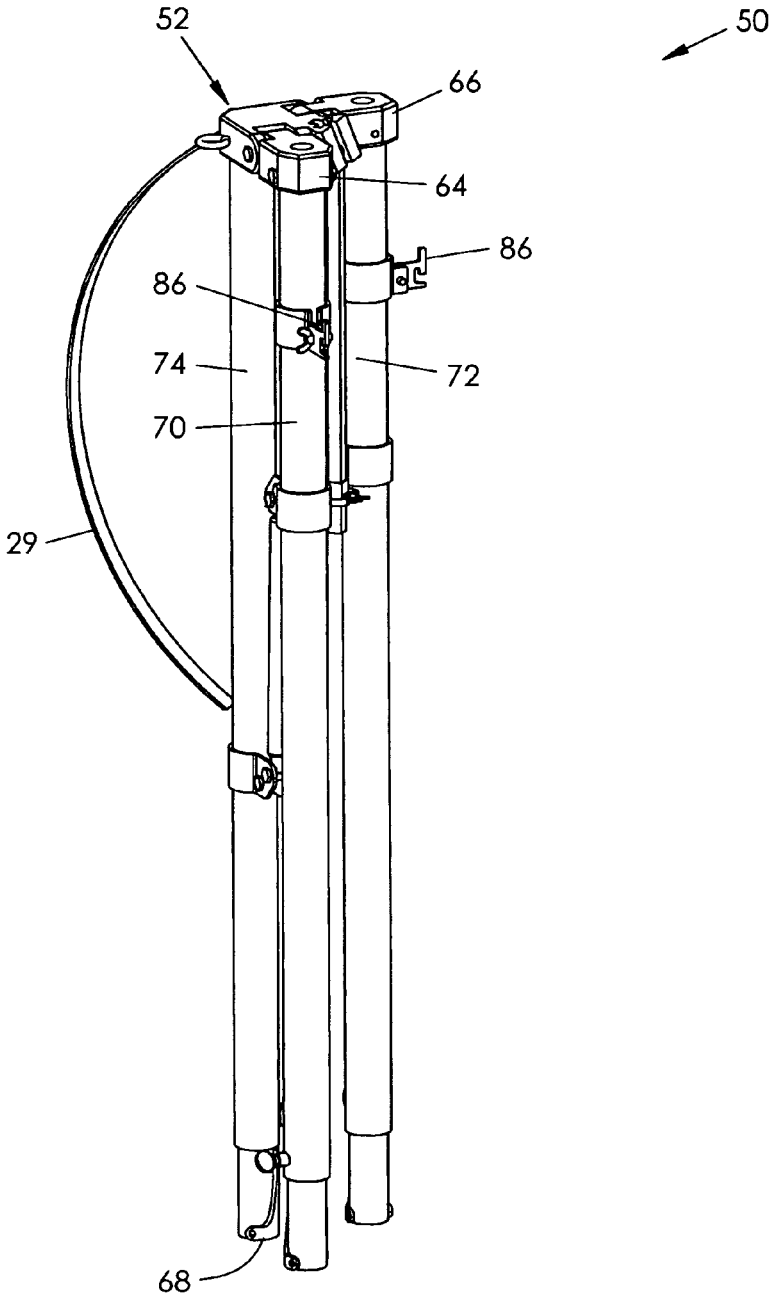
FIG. 17 is a perspective view of a portable easel in a closed/storage configuration.
Figure 18:
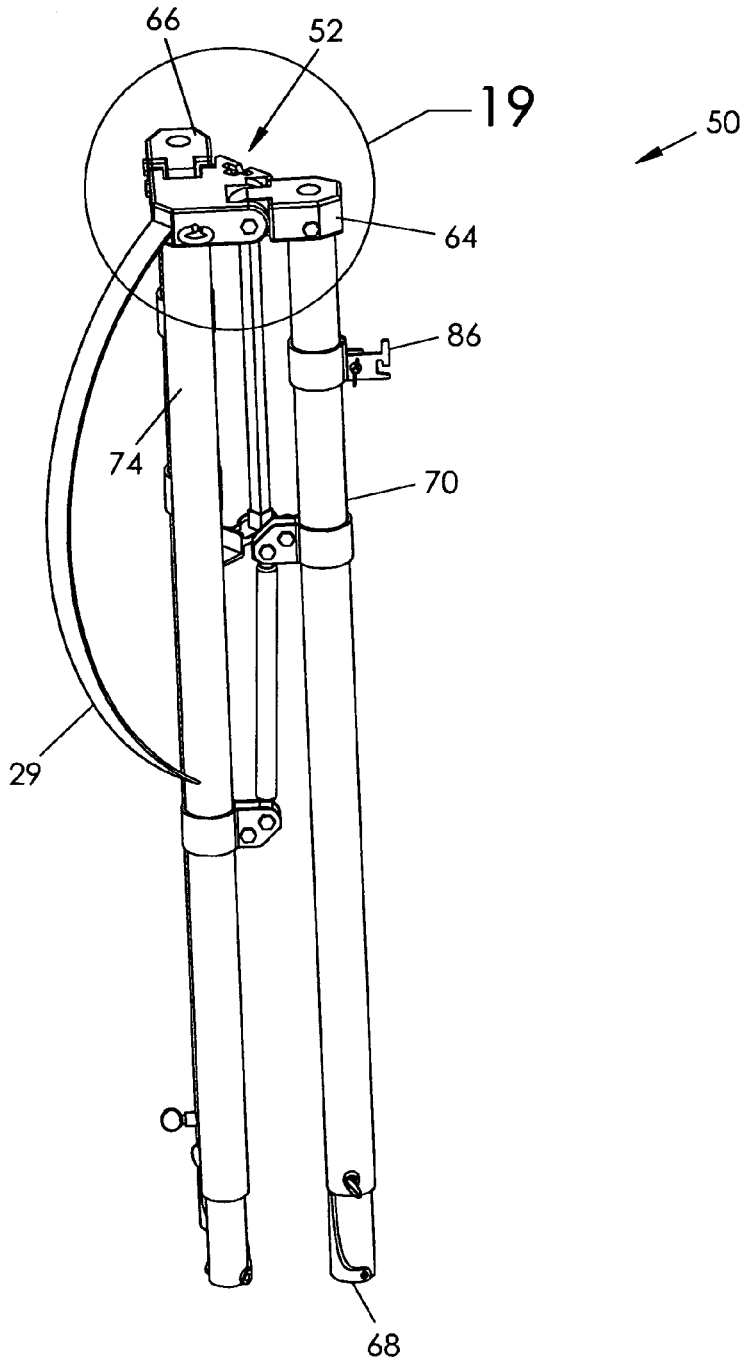
FIG. 18 is a perspective view of the easel as in FIG. 17 taken from another angle.
Figure 19:
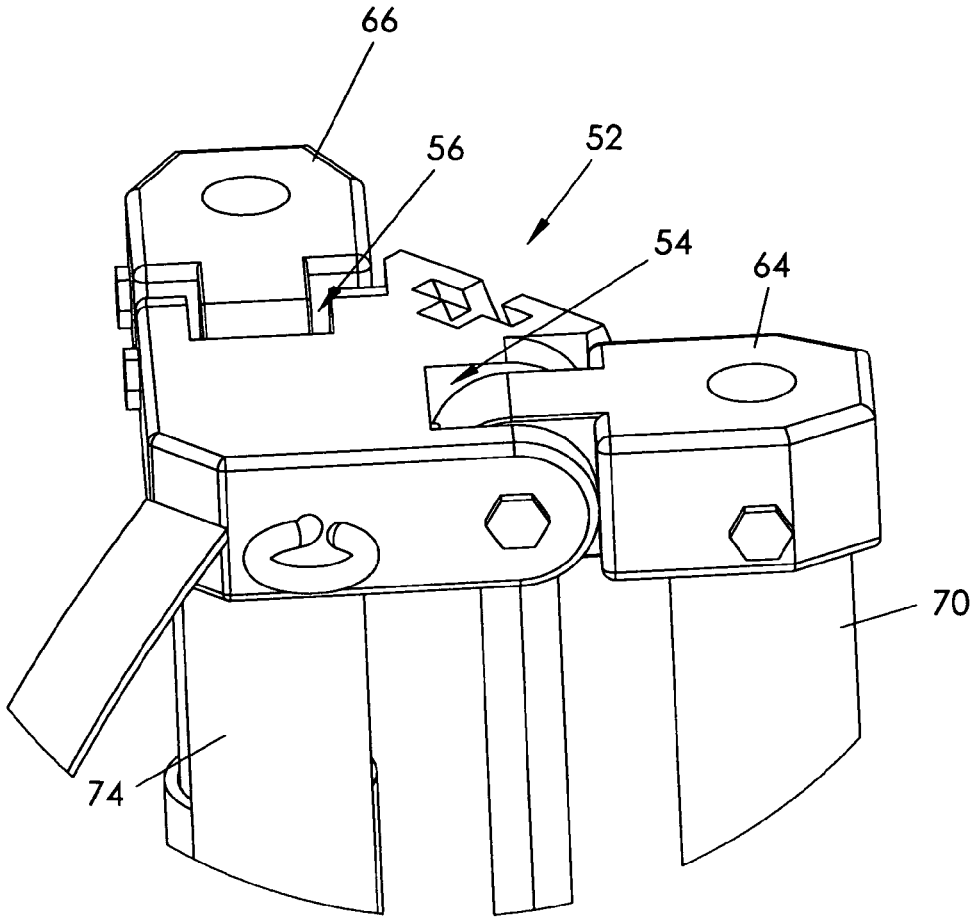
FIG. 19 is an isolated view on an enlarged scale of a cap plate taken from a portion of FIG. 18.
Figure 20:
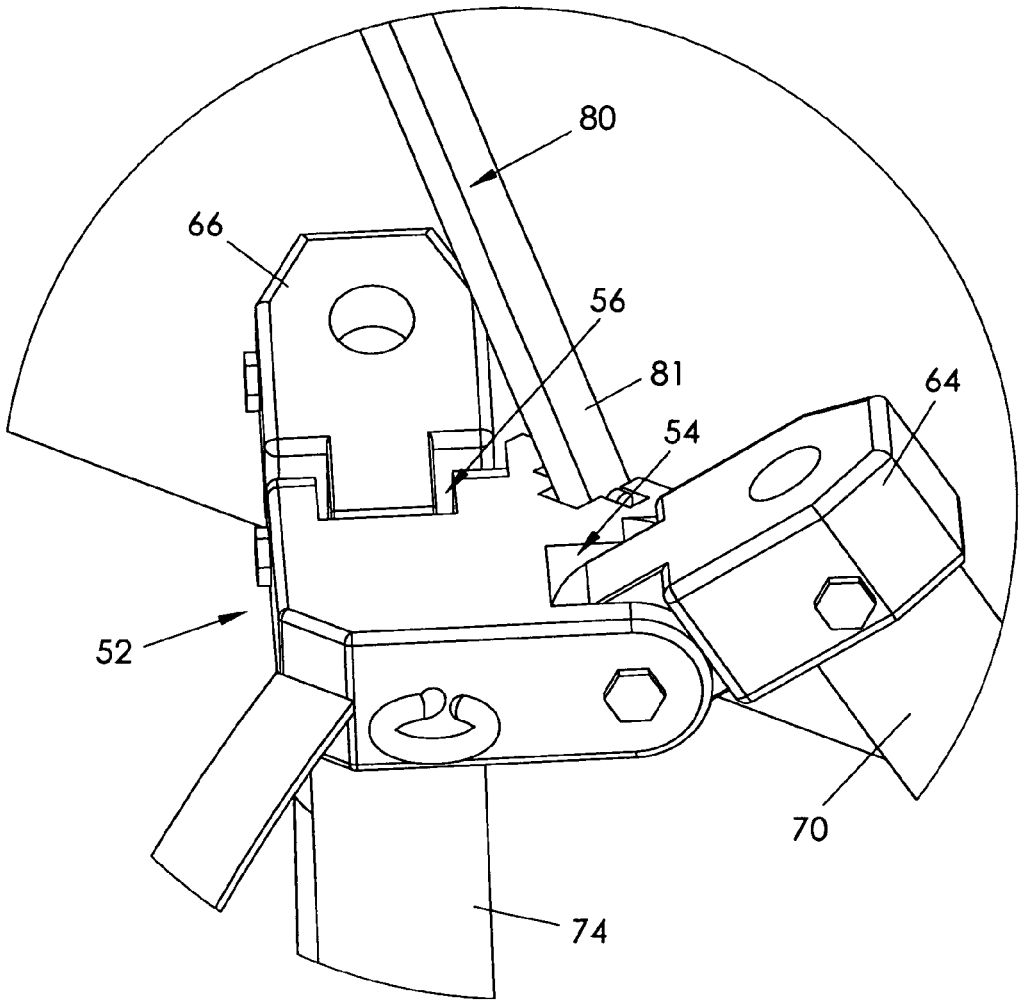
FIG. 20 is another view as in FIG. 19 with the legs in an open configuration.
Figure 23:
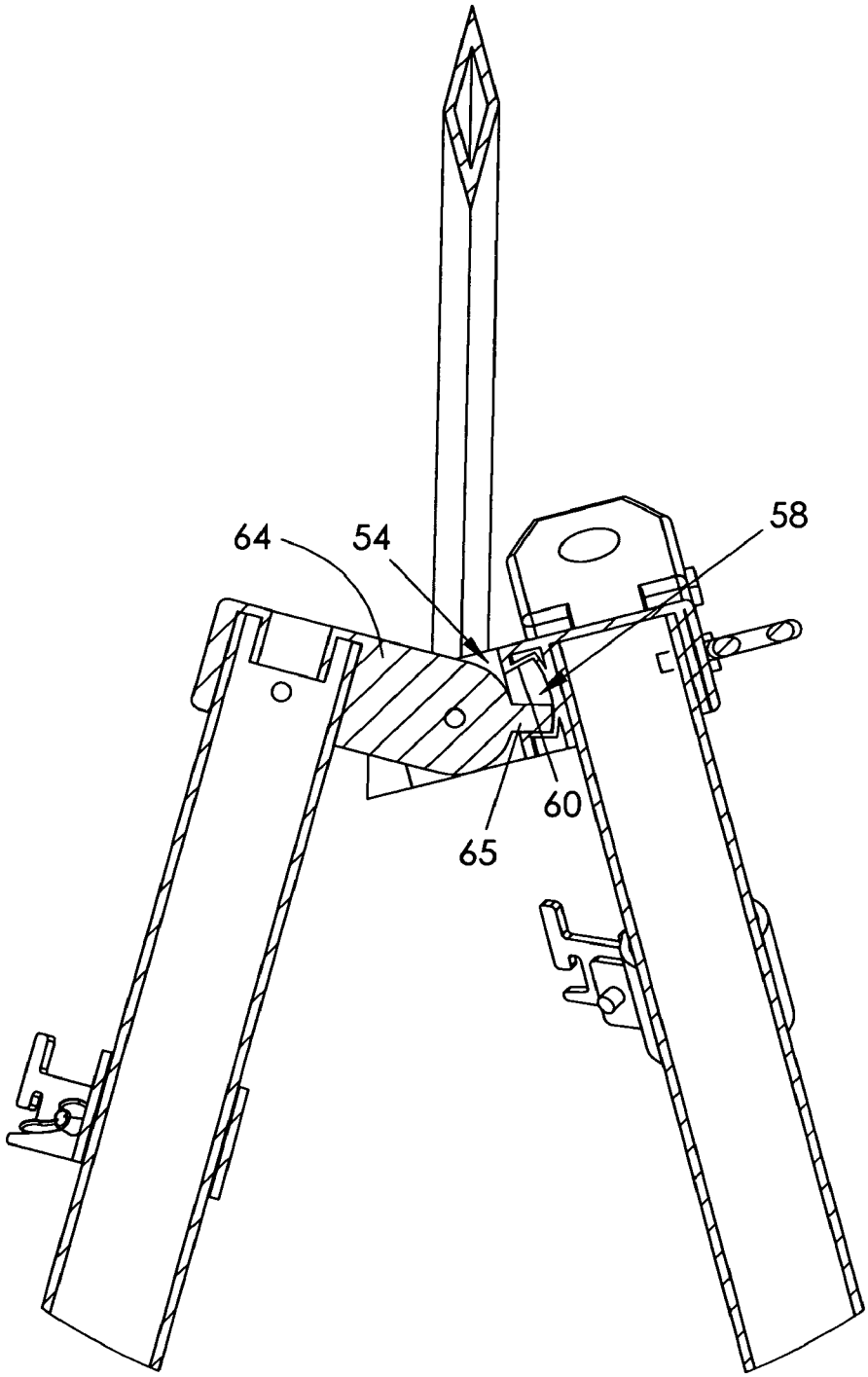
FIG. 23 is an isolated view on an enlarged scale taken from a portion of FIG. 22 with the legs in an open configuration.
Figure 24:
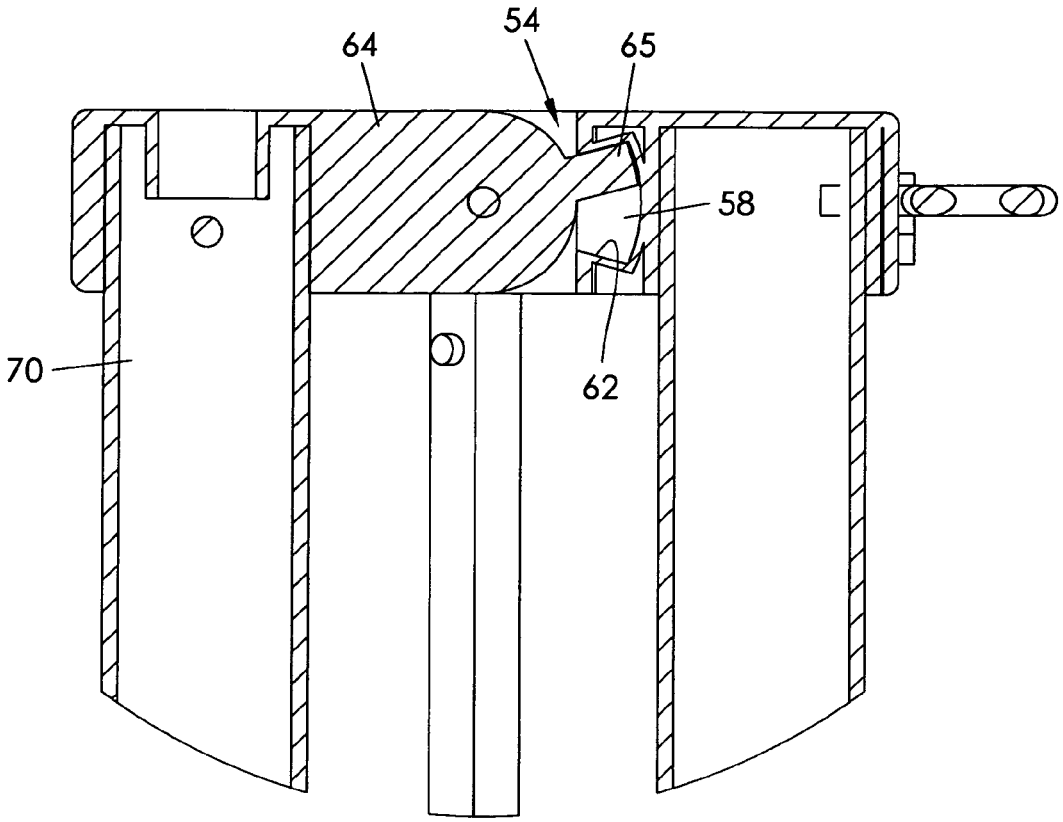
FIG. 24 another isolated view as in FIG. 23 with the legs in a closed configuration.

A portable easel 50 according to another embodiment of the present invention is shown in FIGS. 16 to 27 and includes a construction substantially similar to that described previously except as specifically described below. Reference numerals identified previously will be used consistently here for structures that are substantially identical to those described previously. More particularly, the portable easel 50 includes a cap plate 52 at the apex of the device. The cap plate 52 includes first 54 and second 56 leg receiving areas that are spaced apart from one another and configured to be coupled to upper ends of first 70 and second 72 legs (FIGS. 19 and 20). In addition, each leg receiving area defines a cavity 58 having upper 60 and lower 62 walls as will be further described later. The portable easel 50 further includes first 64 and second 66 coupling members attached to upper ends of first 70 and second 72 legs, respectively. The first coupling member 64 includes a first flange 65 extending outwardly from a terminal end thereof (FIGS. 23, 24). Similarly, the second coupling member 66 includes a second flange (not shown) extending outwardly from a terminal end thereof. In addition, the portable easel includes a third leg 74 that is fixedly attached to a bottom side of the cap plate 52 and depends therefrom.

The first 64 and second 66 coupling members are pivotally coupled to the first 54 and second 56 receiving areas. More particularly, the flanges of the coupling members are received into the cavities defined by the coupling areas, respectively, the cavities having a configuration complementary to the flanges. As the flanges are pivotally movable within each cavity, the first 70 and second 72 legs are pivotally movable between open and closed configurations. A third leg 74 is fixedly attached to a bottom side of the cap plate 52 and extends downwardly therefrom.

The upper 60 and lower 62 walls of the cavities act as stops relative to the pivotal movement of the flanges. In other words, as the first or second leg is pivotally moved between open and closed configurations, such as through operation of the gas springs, respective flanges are moved toward a respective cavity wall and movement is stopped thereby. This is advantageous in that the rigidity and stability of this tripod device is not placed on the gas springs themselves but rather on the more robust stops of the cap plate 52.

Figure 21:
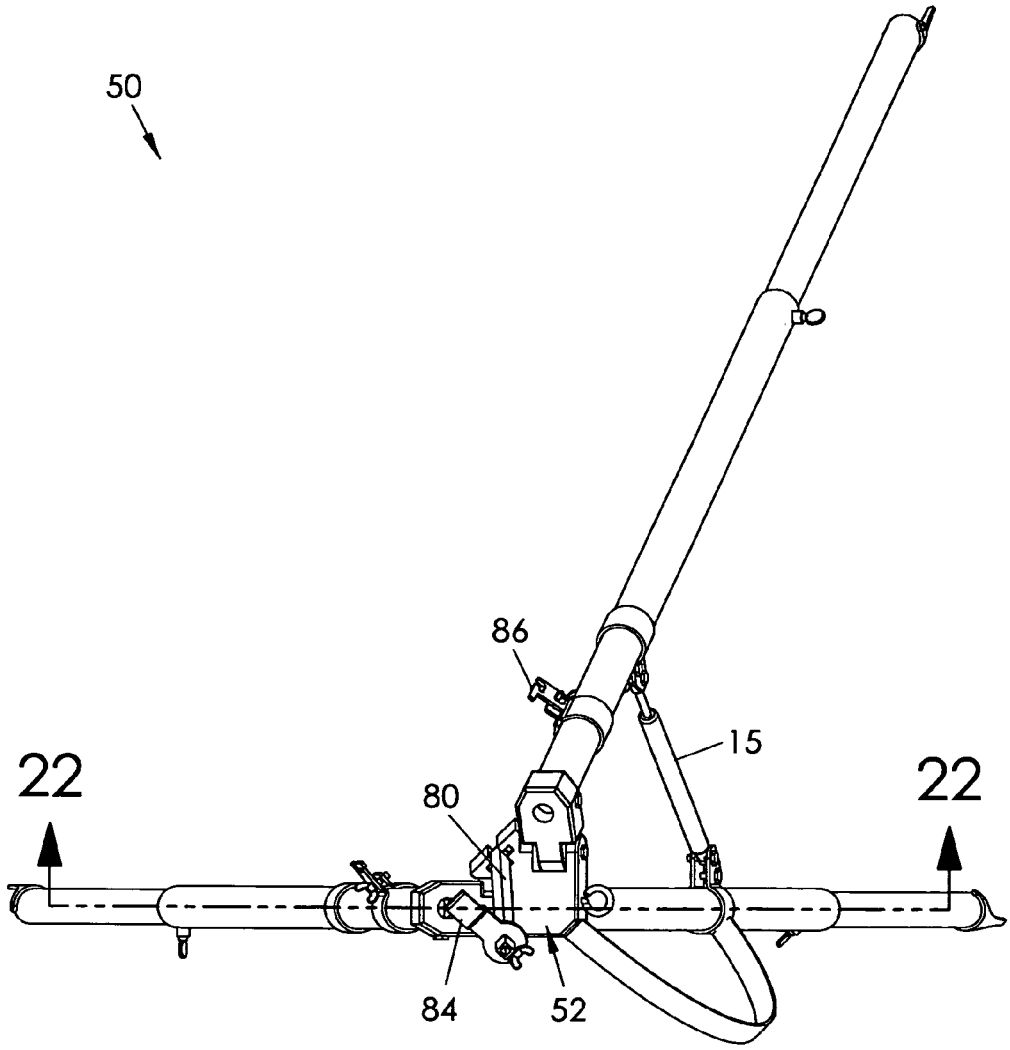
FIG. 21 is a top view of the easel as in FIG. 16 with the canvas removed.
Figure 22:
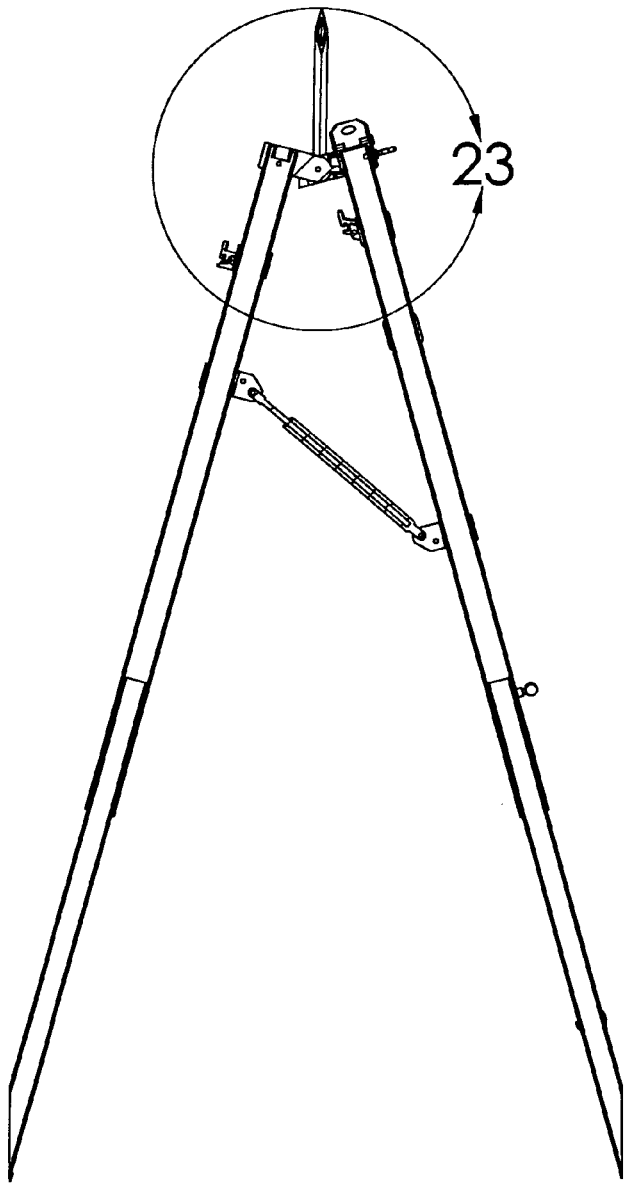
FIG. 22 is a sectional view taken along line 22-22 of FIG. 21.

The portable easel 50 includes an upper artist's canvas support bar 80 having lower 81 and upper 82 ends. The lower end 80 is pivotally coupled to the cap plate 52 as particularly shown in FIG. 20. An upper support bracket 84 is coupled to an upper end of the canvas support bar 80 (FIG. 16) that is configured to secure an upper edge of a painter's canvas. A lower support bracket 86 is coupled to each of the first 54 and second 56 legs generally adjacent upper ends thereof (FIGS. 17, 18, and 21). Each lower support bracket 86 is adjustable for movement along a respective leg, so as to accommodate supporting a canvas of various heights.

Figure 25:
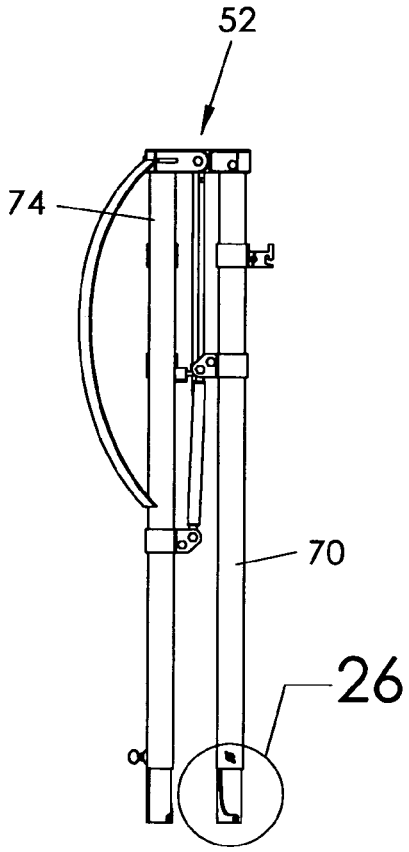
FIG. 25 is a perspective view of the easel in a closed/storage configuration.
Figure 26:
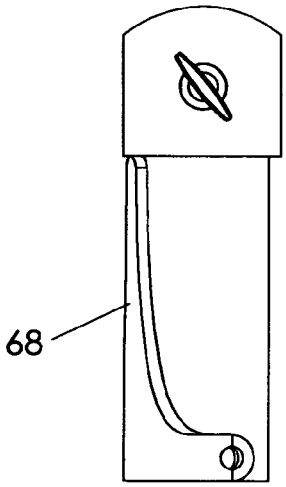
FIG. 26 is an isolated view on an enlarged scale taken from a portion of FIG. 25 with a stake in a retracted configuration.
Figure 27:
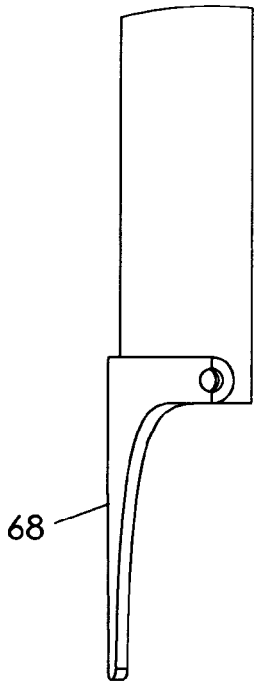
FIG. 27 is another isolated view taken from FIG. 25 with the stake in an extended configuration.

Further, the portable easel 50 according to this embodiment includes a plurality of ground stakes 68. More particularly, a stake 68 is pivotally coupled to a lower end of each respective leg (FIGS. 25-27). Each stake 68 is movable between a storage configuration in which the stake 68 is entirely adjacent the respective leg (FIG. 26) and a use configuration extending downwardly from the lower end of the leg (FIG. 27).

Figure 16:
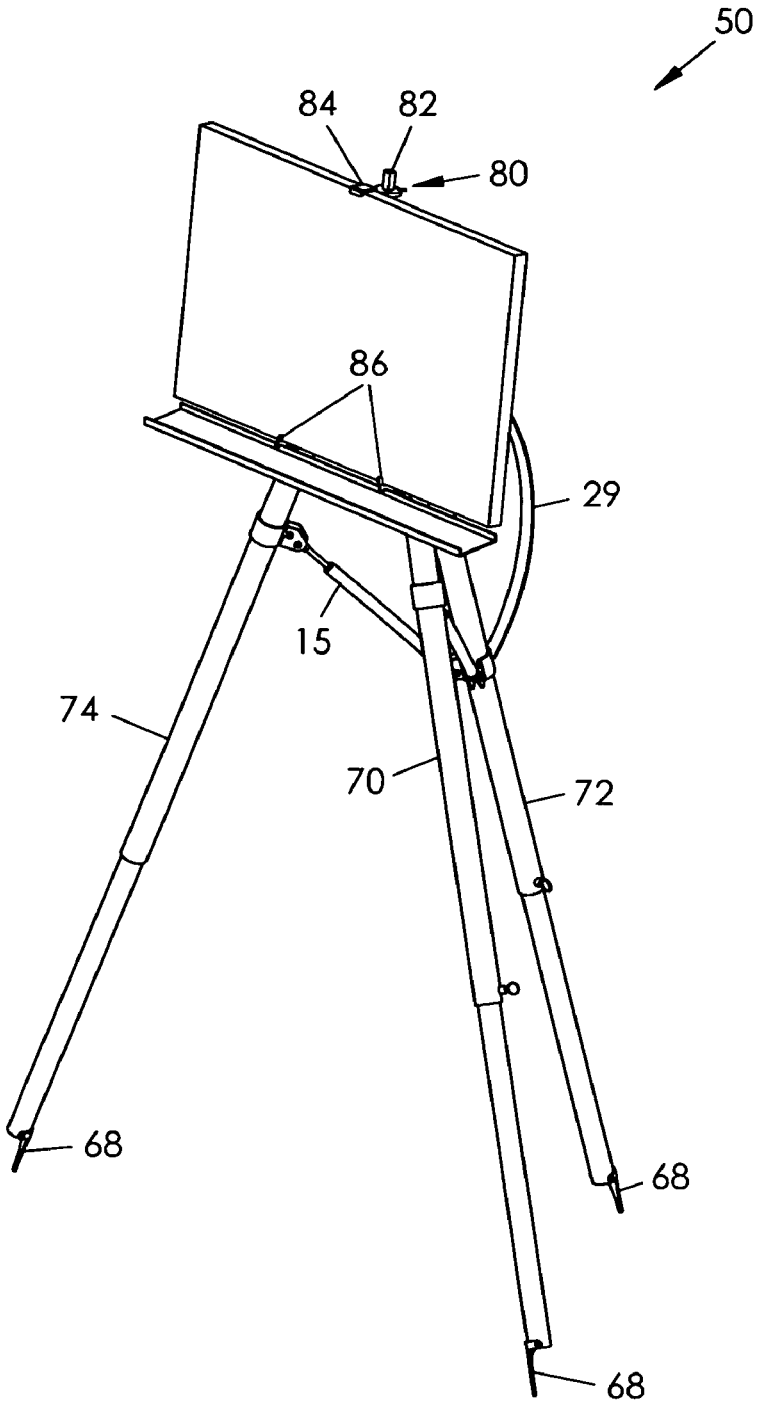
FIG. 16 is a perspective view of a portable easel according to another embodiment of the present invention in an open configuration.

In use, the first 70 and second 72 legs are automatically biased outwardly when the gas springs 15 are actuated such that the legs are pivotally moved from a closed/storage configuration (FIGS. 17-19) to an open/use configuration (FIGS. 16, 20). With the legs in a closed configuration, a flange is in a stop configuration and thus bearing against an upper wall 60 of a cavity (FIG. 24). With the legs in an open configuration, a flange is in a stop configuration bearing against a lower wall 62 of a cavity (FIG. 23). The stop assembly provides enhanced rigidity to the portable easel as well as greater longevity of the gas springs 15 in that the stop structures bear more of the load of holding either an open or closed configuration rather than the springs. When the easel 50 is being positioned at a ground position (i.e. outdoors and not on a hard surface like concrete), the ground stakes may be pivoted to the use/extended configurations are inserted into the ground so that the easel does not move inadvertently during use.

It is understood that while certain forms of this invention have been illustrated and described, it is not limited thereto except insofar as such limitations are included in the following claims and allowable functional equivalents thereof.

The invention claimed is:

1. A portable easel for use in holding an artist's canvas, comprising:

a cap plate defining a first leg receiving area and a second leg receiving area spaced apart from said first leg receiving area;

a first leg having a first coupling member positioned at an upper end thereof that is pivotally coupled to said cap plate at said first leg receiving area such that said first leg is movable between open and closed configurations, said first coupling member having a first flange at a terminal end thereof;

a second leg having a second coupling member positioned at an upper end thereof that is pivotally coupled to said cap plate at said second leg receiving area such that said second leg is movable between open and closed configurations, said second coupling member having a second flange at a terminal end thereof;

a third leg fixedly attached to said cap plate;

wherein said first leg receiving area defines a cavity configured to receive said first flange and having opposed walls for stopping said first flange so as to hold said first leg at said open and closed configurations, respectively;

wherein said second leg receiving area defines a cavity configured to receive said second flange and having opposed walls for stopping said second flange to hold said second leg at said open and closed configurations, respectively;

a plurality of gas springs operatively coupled to respective legs;

wherein said respective first, second, and third legs include telescopic inserts;

an upper artist's canvas support bar attached to said cap plate and an upper bracket attached to an upper end of said upper artist's canvas support bar; and a lower canvas support bracket attached to each of said first and second legs adjacent upper ends of said first and second legs and configured to hold the artist's canvas.

2. The portable easel as in claim 1, further comprising:

an elastic strap attached to one of said respective legs for selectively coupling said three legs together; and a shoulder strap coupled at one end to said cap plate and at another end to one of said respective legs so as to transport said easel to an area of choice.

3. The portable easel as in claim 1, wherein each of said respective legs include telescoping leg extensions so as to selectively increase the length of said respective legs and to adjust the orientation of the artist's canvas.

4. The portable easel as in claim 1, wherein:

said respective legs are adjacent to one another at said closed configuration and are increasingly separated from one another away from said cap plate at said open configuration; and said gas springs bias said first and second legs toward either said storage configuration or said use configuration when said legs are partially urged in a respective direction by a user.

5. The portable easel as in claim 1, further comprising a stake pivotally coupled to a lower end of each respective leg, each stake being movable between a storage configuration adjacent said each respective leg and a use configuration extending downwardly from said lower end.

6. A portable easel for use in holding an artist's canvas, comprising:

a cap plate defining a first leg receiving area and a second leg receiving area spaced apart from said first leg receiving area;

a first leg having a first coupling member positioned at an upper end thereof that is pivotally coupled to said cap plate at said first leg receiving area such that said first leg is movable between open and closed configurations, said first coupling member having a first flange at a terminal end thereof;

a second leg having a second coupling member positioned at an upper end thereof that is pivotally coupled to said cap plate at said second leg receiving area such that said second leg is movable between open and closed configurations, said second coupling member having a second flange at a terminal end thereof;

a third leg fixedly attached to said cap plate;

wherein said first leg receiving area defines a cavity configured to receive said first flange and having opposed walls for stopping said first flange to hold said first leg at said open and closed configurations, respectively;

wherein said second leg receiving area defines a cavity configured to receive said second flange and having opposed walls for stopping said second flange to hold said second leg at said open and closed configurations, respectively;

a plurality of gas springs operatively coupled to respective legs;

wherein said first, second, and third legs include telescopic inserts;

wherein each of said respective legs include telescoping leg extensions so as to selectively increase the length of said respective legs and to adjust the orientation of the artist's canvas;

wherein:

said respective legs are adjacent to one another at said closed configuration and are increasingly separated from one another away from said cap plate at said open configuration;

said gas springs bias said first and second legs toward either said storage configuration or said use configuration when said legs are partially urged in a respective direction by a user;

an upper artist's canvas support bar and bracket attached to said cap plate and configured to secure said painter's canvas;

a lower canvas support bracket having a configuration so as to hold a utility tray secure said painter's canvas.

7. The portable easel as in claim 6, further comprising:

an elastic strap attached to one of said respective legs for selectively coupling said three legs together; and a shoulder strap coupled at one end to said cap plate and at another end to one of said respective legs so as to transport said easel to an area of choice.

8. The portable easel as in claim 6, further comprising a stake pivotally coupled to a lower end of each respective leg, each stake being movable between a storage configuration adjacent said each respective leg and a use configuration extending downwardly from said lower end.

* * * * *